US009845606B2

(12) United States Patent
Chilton

(10) Patent No.: US 9,845,606 B2
(45) Date of Patent: Dec. 19, 2017

(54) SAFETY RAIL SYSTEM AND METHOD FOR USING SAME

(71) Applicant: National Trench Safety, Houston, TX (US)

(72) Inventor: Ronald W. Chilton, Conroe, TX (US)

(73) Assignee: NATIONAL TRENCH SAFETY, Houston, TX (US)

( * ) Notice: Subject to any disclaimer, the term of this patent is extended or adjusted under 35 U.S.C. 154(b) by 150 days.

(21) Appl. No.: 14/480,594

(22) Filed: Sep. 8, 2014

(65) Prior Publication Data

US 2014/0374682 A1 Dec. 25, 2014

Related U.S. Application Data

(63) Continuation of application No. 13/012,895, filed on Jan. 25, 2011, now Pat. No. 8,827,037.

(51) Int. Cl.

| | |
|---|---|
| ***E04G 21/32*** | (2006.01) |
| ***E04G 5/14*** | (2006.01) |
| ***E01F 13/02*** | (2006.01) |
| ***E04H 17/14*** | (2006.01) |
| ***E04H 17/22*** | (2006.01) |

(52) U.S. Cl.

CPC ..... *E04G 21/3242* (2013.01); *E01F 13/022* (2013.01); *E04G 5/14* (2013.01); *E04G 21/3204* (2013.01); *E04H 17/1421* (2013.01); *E04H 17/22* (2013.01); *Y10T 29/49826* (2015.01); *Y10T 29/49947* (2015.01)

(58) Field of Classification Search

CPC . Y10T 29/49947; E04G 5/14; E04G 21/3204; E04G 21/3242

See application file for complete search history.

(56) References Cited

U.S. PATENT DOCUMENTS

| | | | | |
|---|---|---|---|---|
| 1,707,894 | A | 4/1929 | Bergesen, Sr. | |
| 2,821,762 | A | 2/1958 | Foose | |
| 3,736,629 | A | 6/1973 | Blake | |
| 3,863,899 | A | 2/1975 | Werner | |
| D236,941 | S * | 9/1975 | Seavers | D8/72 |
| 4,037,824 | A | 7/1977 | Whitmer | |
| 4,619,447 | A | 10/1986 | Blake | |
| 4,733,842 | A | 3/1988 | Wilkerson | |
| 5,029,670 | A | 7/1991 | Whitmer | |
| 5,464,070 | A | 11/1995 | Griek et al. | |
| 5,529,144 | A * | 6/1996 | Henderson | A62B 35/0068 182/3 |
| 5,718,305 | A | 2/1998 | Palmer | |
| 6,036,146 | A | 3/2000 | Paterson | |
| 6,038,829 | A | 3/2000 | Franks | |
| 6,039,150 | A | 3/2000 | Palmer | |
| 6,053,281 | A | 4/2000 | Murray | |
| 6,098,942 | A * | 8/2000 | Heath | F16B 2/065 248/228.6 |
| 6,173,809 | B1 | 1/2001 | Cole et al. | |

(Continued)

*Primary Examiner* — Colleen M Chavchavadze

(74) *Attorney, Agent, or Firm* — Edmonds & Cmaidalka

(57) ABSTRACT

Embodiments of the disclosure provide a safety rail. The safety rail may include a body disposed on first and second adjustable boots. The first and second adjustable boots may be adapted to secure the safety rail to an excavation support structure. The body may include a lower rail connected to the first and second adjustable boots.

20 Claims, 2 Drawing Sheets

(56) References Cited

U.S. PATENT DOCUMENTS 6,357,119 B1 * 3/2002 Acerra ..... B08B 9/023 15/104.04
6,439,344 B1 8/2002 Cole
6,533,069 B1 3/2003 Hohnson
6,585,080 B2 * 7/2003 Murray ..... E04G 21/3233 182/113
6,830,127 B2 12/2004 Hohnson
6,931,793 B2 9/2005 Joyce
6,978,737 B2 * 12/2005 Kirch ..... A01K 1/04 119/769
7,048,090 B2 5/2006 Dean et al.
7,234,689 B2 6/2007 Kuenzel
7,284,746 B2 * 10/2007 Kuenzel ..... E04G 21/3233 182/106
7,509,702 B2 3/2009 Cantis et al.
7,530,551 B2 * 5/2009 Kuenzel ..... E04G 21/3233 182/113
7,743,556 B2 6/2010 Stofels
7,806,232 B2 10/2010 Thomas et al.
7,832,148 B2 * 11/2010 Stoffels ..... E05B 65/0007 292/194
2003/0042072 A1 3/2003 Murray
2004/0195479 A1 * 10/2004 Gulley ..... F16B 2/12 248/228.1
2006/0054388 A1 3/2006 Reeves
2006/0163002 A1 7/2006 Langsmead
2006/0237263 A1 10/2006 Gaines
2006/0272889 A1 12/2006 Paquette
2008/0006809 A1 1/2008 Stoffels et al.
2010/0229355 A1 * 9/2010 Wang ..... F16B 2/10 24/489
2010/0264390 A1 10/2010 Cerda
2010/0294592 A1 11/2010 Crook et al.
2010/0299891 A1 * 12/2010 Myers ..... F16L 3/1211 24/457
2015/0068010 A1 * 3/2015 Klingler ..... F16B 2/185 29/426.1

* cited by examiner

FIG. 2
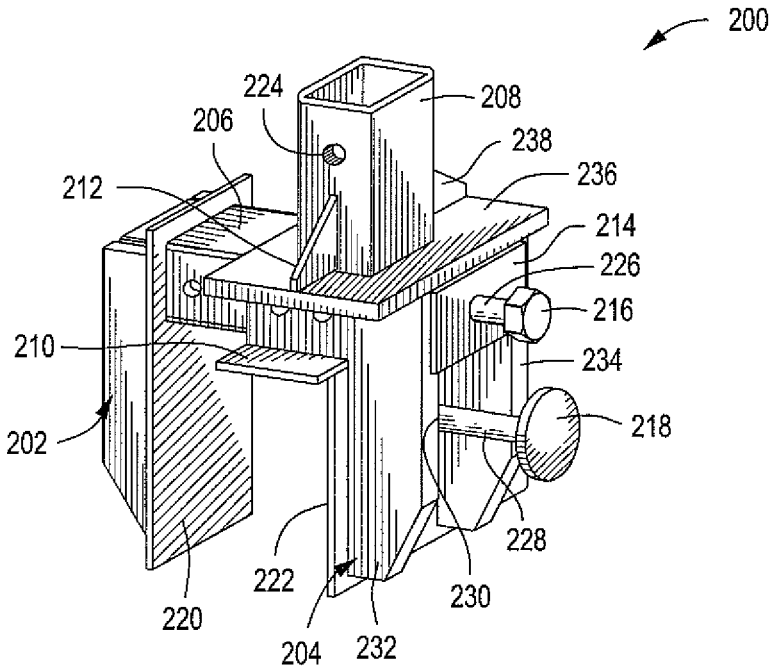
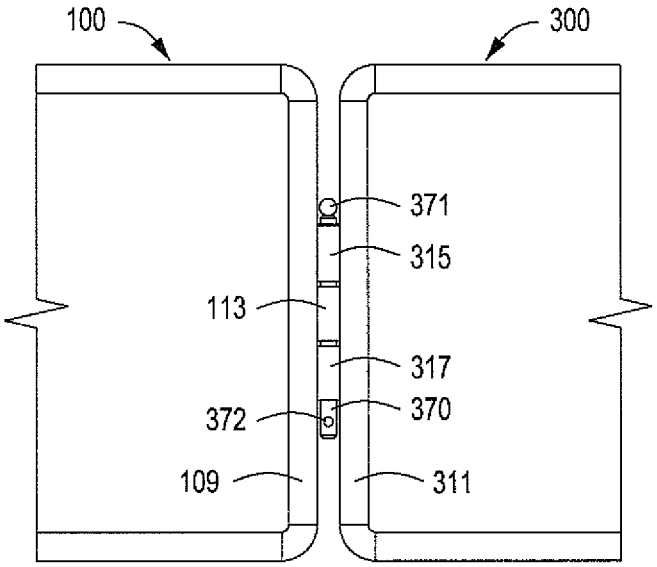
FIG. 3

SAFETY RAIL SYSTEM AND METHOD FOR USING SAME

BACKGROUND

Field

Embodiments of the present disclosure generally relate to fall prevention, and more particularly, to construction site fall protection.

Description of the Related Art

In the United States, falls make up over one-third of all construction fatalities. Over 250,000 non-fatal injuries from falls occurred in 2007 alone. The Code of Federal Regulations (CFR) specifies that an employer must utilize a fall protection system whenever an employee may fall six feet or more from any surface. Additionally, at an edge of an excavation, well, pit, shaft, hole, etc., that is six feet or more in depth and is not readily visible, employees must be protected from falls by guardrail systems, fences, barricades, or covers as appropriate.

Often conventional guardrail systems, fences, and barricades are unwieldy and difficult to install and disassemble. Some conventional guardrail systems, fences, and barricades can only be used with specific construction equipment with fixed sizes or connections. Other guardrail systems, fences, or barricades previously used do not comply with heightened federal safety standards.

There is a need, therefore, for a safety rail system that meets current safety standards, is easily moveable, and is easily attachable to various construction site fixtures or structures.

SUMMARY

Embodiments of the disclosure provide a safety rail. The safety rail may include a body disposed on first and second adjustable boots. The first and second adjustable boots may be adapted to secure the safety rail to an excavation support structure. The body may include a lower rail connected to the first and second adjustable boots.

Embodiments of the disclosure may further provide a safety rail for an excavated area. The safety rail may include a body having an upper rail and a lower rail. The upper and lower rails may be connected to a first adjustable boot via a first base leg. The first adjustable boot may be adapted to secure the safety rail to an excavation support structure.

Embodiments of the disclosure may further provide a method for protecting an excavation area. The method may include disposing a first adjustable boot and a second adjustable boot of a first safety rail onto an excavation support structure. The first safety rail may include a body having a lower rail connected to the first and second adjustable boots. The method may also include securing the first and second adjustable boots to the excavation support structure.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

FIG. 2 depicts an isometric view of an illustrative boot for a safety rail, according to one or more embodiments described.

FIG. 3 depicts a partial elevation view of a connection between two safety rails, according to one or more embodiments described.

DETAILED DESCRIPTION

Figure 1:
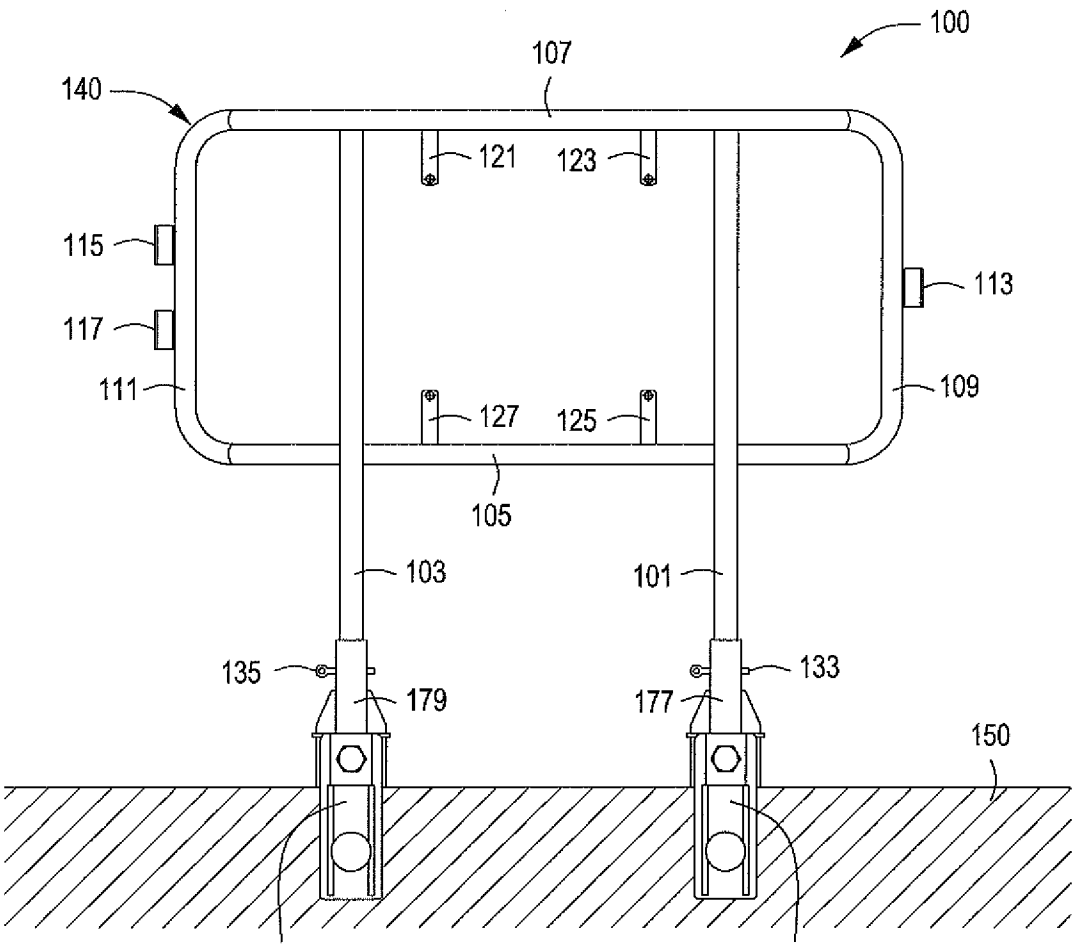
FIG. 1 depicts an elevation view of an illustrative safety rail, according to one or more embodiments described.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

The terms "up" and "down"; "upward" and "downward"; "upper" and "lower"; "upwardly" and "downwardly"; "above" and "below"; and other like terms as used herein refer to relative positions to one another and are not intended to denote a particular spatial orientation since the apparatus and methods of using the same may be equally effective at various angles or orientations.

FIG. 1 depicts a side view of an illustrative safety rail 100, according to one or more embodiments. The safety rail or handrail 100 generally includes a body 140. The body 140 may include a first or "upper" rail 107 and/or a second or "lower" rail 105. The upper rail 105 and/or the lower rail 107 may be connected to a first boot 171 and/or a second boot 173. For example, the rails 105, 107 may be connected to the first and second boots 171, 173 via a first base leg 101 and a second base leg 103, respectively. Although not shown, in another example, the lower rail 105 may be directly connected to the first and second boots 171, 173.

The boots 171, 173 are generally adapted to secure the safety rail 100 to a rigid or structurally supportive base at a construction site, excavation site, work zone, or the like. Exemplary base structures include excavation support structures (e.g., trench shoring walls, trench shield walls, aluminum trench box walls, shoring panels, slide rail panels, combinations of the same, or the like), beams, scaffolds, slabs, or the like. For example, the boots 171, 173 may clamp onto the top edge of a wall 150 such as a trench box wall or shoring panel. Although not shown, the boots 171, 173 may be oriented at 90 degrees with respect to the base legs 101, 103 to allow connection of the safety rail 100 to substantially horizontal surfaces, such as a slab edge. The boots 171, 173 may be adjustable to a plurality of angles to allow attachment to surfaces having corresponding angles.

The base legs 101, 103 may be positioned between ends of the upper rail 107 and/or ends of the lower rail 105. The lower rail 105 may be disposed on or otherwise attached to the first base leg 101 and the second base leg 103. For example, the lower rail 105 may be welded, pinned, riveted, bolted, or otherwise secured between the first and second base legs 101, 103. In another example, the lower rail 105 may extend beyond the base legs 101, 103 at either end. Although shown as a single piece, the lower rail 105 may be formed of several pieces secured between the base legs 101, 103 and on either side of the base legs 101, 103. The upper rail 107 is generally disposed on or otherwise attached to upper ends of the first and second base legs 101, 103. For example, the upper rail 107 may be welded, pinned, riveted, bolted, or otherwise secured to the top of the first and second base legs 101, 103.

A first post 109 and a second post 111 may be disposed proximate either end of the upper rail 107 and/or either end of the lower rail 105, outside of the base legs 101, 103. For example, the first post 109 may be dispose between the upper and lower rails 107, 105 at first ends thereof, and the second post 111 may be disposed between the between the upper and lower rails 107, 105 at second ends thereof. In another example, the first post 109 may be disposed between the first base leg 101 and an end of either of the upper or lower rails 107, 105, and the second post 111 may be disposed between the second base leg 103 and an end of either of the upper or lower rails 107, 105. One end of each of the posts 109, 111 is generally attached to an end of the upper rail 107, but may be attached somewhere in between. Another end of each of the posts 109, 111 may be attached to an end of the lower rail 105 and/or to one of the base legs 101, 103. For example, the posts 109, 111 may be welded, pinned, riveted, bolted, or otherwise secured to opposing ends of the lower and upper rails 105, 107. Although not shown, one or more additional posts may be added to the body 140 to provide increased strength. Although shown as separate pieces, any two or more of the rails 105, 107 and the posts 109, 111 may be formed out of one piece, e.g., out of a single shaped pipe.

The rails 105, 107, the posts 109, 111, and the base legs 101, 103 may be solid and/or hollow. In at least one embodiment, the rails 105, 107, the posts 109, 111, and the base legs 101, 103 may all be pipe, tubular steel, or a combination thereof. For example, the rails 105, 107 and the posts 109, 111 may be round steel pipes and the base legs 101, 103 may be substantially square tubular steel.

The rails 105, 107, the posts 109, 111, and the base legs 101, 103 may have the same cross-sectional shape, or they may have a different cross-sectional shape, as desired. Exemplary cross-sectional shapes include, but are not limited to, circular, square, squared with rounded corners, triangular, elliptical, diamond-shaped, pentagonal, hexagonal, trapezoidal, or the like. For example, the base legs 101, 103 may have a squared cross-sectional shape and the rails 105, 107 and the posts 109, 111 may be circular. The base legs 101, 103 may have similar sized cross-sectional area to the posts 109, 111 and/or rails 105, 107, or may be larger or smaller as desired. For example, the cross-sectional area of the base legs 101, 103 may be about two to three times the cross-sectional area of the posts 109, 111. In another example, the base legs 101, 103 may be about 3.8 cm by about 3.8 cm square in cross-section and the posts 109, 111 and rails 105, 107 may be circular in cross-section, each having a diameter of about 2.5 cm.

It will be appreciated that any number of boots and base legs may be used for a safety rail 100. Although not shown, the safety rail 100 may have a single base leg, for example, that is disposed on the rail 107. In another example, the single base leg may be disposed between the posts 109, 111. A single boot may be used with the single base leg. The single boot and single base leg configuration may be used for a safety rail 100 that is less than about 90 cm in length, for example. In another example, the safety rail 100 may have three, four, five, or more base legs and corresponding boots.

Although not shown, the body 140 may be formed of one piece. For example, the body 140 and the base legs 101, 103 may be a uniform piece of metal, plastic, fiberglass, or the like, disposed directly on the boots 171, 173. In another example, the body 140 may be a uniform piece connected to boots 171, 173 via the base legs 101, 103, respectively. In another example, the body 140 may be directly connected to the first boot 171 and/or the second boot 173.

The first base leg 101 may be disposed on a first connector 177 of the first boot 171, and the second base leg 103 may be disposed on a second connector 179 of the second boot 173. In at least one embodiment, the connectors 177, 179 may be sleeves and the base legs 101, 103 may fit inside the connectors 177, 179. In another embodiment, the base legs 101, 103 may be hollow or have a hollow portion, and the connectors 177, 179 may be posts, whereby the base legs 101, 103 generally fit over or around the connectors 177, 179.

The base legs 101, 103 may be removably secured, respectively, to the first and second connectors 177, 179 of the boots 171, 173. In at least one embodiment, one or more pins (two are shown 133, 135) may, at least partially, secure the base legs 101, 103 onto/into the connectors 177, 179 of the boots 171, 173. For example, a first pin 133 may be at least partially disposed through aligned holes in the first base leg 101 and aligned holes in the first connector 177 of the first boot 171. Likewise, a second pin 135 may be at least partially disposed through aligned holes in the second base leg 103 and aligned holes in the second connector 179 of the second boot 173.

One or more hooks or plates (four are shown 121, 123, 125, 127) having fasteners, (e.g., screws, tabs, pins, or the like) may be fixed or secured to the rails 105, 107 to allow one or more placards or signs (not shown) to be disposed on the safety rail 100. The placard (not shown), e.g., a warning sign, may be disposed between the base legs 101, 103 and the first and second rails 105, 107, and joined to one or more of the tabs 121, 123, 125, 127.

The safety rail 100 is generally adapted to connect with one or more other safety rails 100 or another safety mechanism. For example, the safety rail 100 may include one or more barrel hinges or sleeve connectors (three are shown 113, 115, 117) adapted to receive a corresponding pin (not shown) therethrough. A first sleeve connector 113 may be disposed on the first post 109, and a second sleeve connector 115 and a third sleeve connector 117 may be disposed on the second post 111. The first sleeve connector 113 is generally adapted to fit between the second and third sleeve connectors 115, 117 of another adjacent safety rail 100, known as a 2-1 mating system.

Although not shown, more sleeve connectors may be used. For example, the first post 109 and the second post 111 may have from a low of 1, 3, 5, or 7 to a high of 8, 12, 16, or 20 sleeve connectors. The sleeve connectors 113, 115, 117 may vary in height. For example, the height of the sleeve connectors may range from a low of about 5 cm, about 5.5 cm, or about 6 cm to a high of about 6.5 cm, about 7 cm, or about 7.5 cm. As the number of sleeve connectors 113, 115, 117 increases, the height of each sleeve connector 113, 115, 117 may decrease or remain the same, as desired.

The sleeve connectors 113, 115, 117 are generally hollow, i.e., having an opening disposed therethrough, and may have differing cross-sectional shapes or the same cross-sectional shapes, as desired. For example, the sleeve connectors 113, 115, 117 may be hollow cylinders having a circular cross-section. Other cross-sectional shapes may include, but are not limited too, square, squared with rounded corners, triangular, elliptical, diamond-shaped, pentagonal, hexagonal, trapezoidal, or the like. For example, the sleeve connectors 113, 115, 117 may be pipes having a diameter ranging from about 2.5 cm to about 3.3 cm (e.g., 1" SCHD 40 pipe).

Once the sleeve connectors 113, 115, and/or 117 are aligned with connectors (not shown) from adjoining safety rails 100 and/or other objects, a pin, dowel, or other fastener (not shown) may be located therebetween. The fastener (not shown) generally has the same or similar cross-sectional shape as the sleeve connectors 113, 115, 117. Linking the safety rail 100 with other safety rails (not shown) and/or other devices may minimize gaps or the potential for gaps to form between those safety rails and/or devices, thereby improving fall protection.

As illustrated, the connectors 113, 115, 117 may be aligned with connectors (not shown) from adjoining safety rails 100 and/or other objects to receive an external dowel (not shown) therethrough. It will be appreciated, however, that a connection mechanism for coupling two or more safety rails 100 may instead include pins disposed on one post (e.g., on the first post 109) and corresponding barrel connectors disposed on the other post (e.g., on the second post 111) so that the safety rails 100 are universally exchangeable and connectable in series.

The dimensions of the safety rail 100 may vary, as desired. For example, different sized or same sized safety rails 100 may be used together to form a modular safety rail system. The modular safety rail system may include safety rails 100 of different dimensions and/or other devices to provide adaptable fall protection for a variety of construction, work zone, and/or excavation sites. For example, the length of the safety rail 100 may range from a low of about 60 cm, about 121 cm, about 183 cm, about 244 cm, or about 305 cm to a high of about 366 cm, about 427 cm, about 488 cm, about 549 cm, or about 600 cm. In another example, the length of the safety rail 100 may be of from about 90 cm to about 579 cm, about 152 cm to about 518 cm, about 213 cm to about 457 cm, or about 274 cm to about 396 cm.

The same boots 171, 173 may be used for different sized safety rails 100. For example, a 122 cm safety rail 100 may be replaced with a 183 cm safety rail 100 by moving either of the boots 171, 173 over to match the spacing of the base legs 101, 103 of the replacement safety rail 100.

The distance between the base legs 101, 103 may range from a low of about 50 cm, about 70 cm, about 90 cm, or about 110 cm to a high of about 190 cm, about 210 cm, about 230 cm, or about 250 cm. For example, the distance between the base legs 101, 103 may be of from about 60 cm to about 240 cm, about 80 cm to about 220 cm, or about 100 cm to about 200 cm. The base legs 101, 103 may be spaced apart in proportion to the overall size of the safety rail 100, or spaced out of proportion, as desired.

The distance between the base leg 101 and the first post 109 may range from a low of about 25 cm, about 30 cm, about 35 cm, or about 40 cm to about 55 cm, about 60 cm, about 65 cm, or about 70 cm. The distance between the base leg 103 and the second post 111 may be the same as that between the base leg 101 and the first post 109, or it may be different, as desired.

The safety rail 100 may have a top edge height ranging from a low of about 100 cm, about 102 cm, about 104 cm, about 106 cm, or about 108 cm to a high of about 112 cm, about 114 cm, about 116 cm, about 118 cm, or about 120 cm. The "top edge height," as used herein, refers to the height of a top edge of the highest rail (e.g., the height of the upper rail 107) with respect to a walking/working level (not shown) proximate to the safety rail 100. For example, the safety rail 100 may have a top edge height of from about 101 cm to about 119 cm, about 103 cm to about 117 cm, about 105 cm to about 115 cm, or about 107 cm to about 113 cm. In at least one embodiment, the top edge height of the safety rail 100 may be greater than 120 cm. For example, the top edge height of the safety rail 100 may be increased for use with stilts, e.g., by increasing the height of the safety rail 100 commensurate with the height of the stilts.

The lower rail 105 and/or any other midrail (not shown) is generally disposed at a height about midway between the top edge of the safety rail 100 and the walking/working level. The term "midrail," as used herein refers to any substantially horizontal rail between a highest rail of the safety rail 100 and the walking/working level. For example, the lower rail 105 may have a height ranging from a low of about 40 cm, about 44 cm, about 48 cm, or about 52 cm to a high of about 58 cm, about 62 cm, about 66 cm, or about 70 cm from the walking/working level.

The distance between the lower rail 105 and the upper rail 107 may vary between different safety rails 100, or it may be uniform, as desired. For example, the distance between the lower rail 105 and the upper rail 107 may range from a low of about 50 cm, about 52 cm, or about 54 cm to a high of about 56 cm, about 58 cm, or about 60 cm.

Although not shown, screens, mesh, intermediate vertical members, or equivalent intermediate structural members may also be installed between the upper rail 107 and the walking/working level. Screens and/or mesh, when used, may extend from the upper rail 107 to the walking/working level and along any opening between the base legs 101, 103 and/or the posts 109, 111. Although not shown, intermediate members (such as balusters) may be disposed between the base legs 101, 103 and/or the posts 109, 111. Intermediate members, when used, may be less than about 48 cm apart, less than about 42 cm apart, less than about 36 cm apart, or less than about 30 cm apart. Other structural members, e.g., additional midrails and/or architectural panels, may be installed in the safety rail 100 such that there are no openings in the safety rail 100 that are more than 50 cm wide.

The safety rail 100 is generally capable of withstanding, without failure, a force of about 890 N or more applied to the body 140 within about 5 cm of the upper rail 107, in any outward or downward direction. For example, the upper rail 107 may be capable of withstanding such a force at any point along the upper rail 107. The upper rail 107 generally limits and/or prevents deflection of the safety rail 100 to a height of about 100 cm or more above the walking/working level. The lower rail 105 and/or other midrails, in addition to any screens, mesh, intermediate vertical members, solid panels, and equivalent structural members added to the safety rail 100, may be capable of withstanding, without failure, a force of about 666 N or more applied in any downward or outward direction at any point along the lower rail 105 or other member disposed in the safety rail 100. At least a portion of the safety rail 100 may be surfaced to prevent injury to an employee from punctures or lacerations and/or to prevent snagging of clothing.

The safety rail 100 may be of any sufficient durability, rigidity, and strength so that the safety rail 100 meets or exceeds all requirements established by the Occupational Safety and Health Administration ("OSHA"). The safety rail 100 may be strengthened by increasing the number and/or strength of the boots 171, 173 and/or the type and thickness of material used to make the boots 171, 173, rails 105, 107, the posts 109, 111, and/or the base legs 101, 103. The safety rail 100 may also be composed of suitable materials to meet OSHA standards. Such suitable materials may include, but are not limited to, any of one or more metals, fiberglass, wood, composite materials, and plastics, as well as mixtures, blends, and/or copolymers of any and all of the foregoing materials.

In operation, the safety rail 100 is generally utilized at a construction site, work zone, excavation site, or the like, and may be disposed on the exemplary structures discussed and described above. For example, the safety rail 100 may be disposed on protective systems in the excavation itself. The safety rail 100 is generally designed so that one or two people may lift the safety rail 100 and place it in position. Alternatively, the safety rail 100 may be positioned with lifting equipment and/or rigging, e.g., slings, chains, cables, or the like.

In at least one embodiment, the boots 171, 173 of the safety rail 100 may first be disposed on an excavation support structure (e.g., a trench shoring wall, a trench shield wall, an aluminum trench box wall, a shoring panel, a slide rail panel, combinations of the same, or the like) or on other construction site structures (e.g., a beam, ledge, concrete slab, scaffolding, or the like). The boots 171, 173 may be tightened and/or clamped on the excavation support structure and spaced to receive the base legs 101, 103 of the safety rail 100. Once the boots 171, 173 are set and secured, the base legs 101, 103 may be slotted into or onto the connectors 177, 179. The pins 133, 135 may then be disposed through the connectors 177, 179 and the base legs 101, 103 to prevent the base legs 101, 103 from dislodging from the boots 101, 103. In at least one embodiment, the base legs 101, 103 may be secured to the connectors 177, 179 before the safety rail 100 is disposed onto the excavation support structure.

One or more of the safety rails 100 may be disposed adjacent one another at a construction or excavation site to enhance fall protection. In at least one embodiment, one or more of the safety rails 100 may be connected together in series to form a continuous length of fall protection. For example, two safety rails 100 may be connected via one or more of the sleeve connectors 113, 115, 117. In another example, a plurality of safety rails 100 may be connected together in series via their respective sleeve connectors 113, 115, 117. The safety rail 100 may also be joined to another construction device or another structure via the sleeve connectors 113, 115, 117.

The safety rail 100 may be removably disposed across access openings to construction and/or excavation sites, e.g., openings used during hoisting operations, providing fall protection when the access openings are not in use. The safety rail 100 may also be used in conjunction with other fall protection, e.g., covers, safety netting, harnesses, lifelines, access gates, or a combination thereof. For example, the safety rail 100 may be disposed proximate and/or adjacent an access gate, and may be connected to the access gate via the sleeve connectors 113, 115, 117.

FIG. 2 depicts an isometric view of an illustrative boot 200 for a safety rail 100, according to one or more embodiments. The boot 200 generally has a first or "stationary" member 204 and a second or "moveable" member 202 that face one another, where the moveable member 202 moves relative to the stationary member 204. The stationary member 204 generally resembles an upside down "L" shape and may be formed of one piece or of multiple pieces secured together. For example, the stationary member 204 may be formed, at least partially, of one or more upside down "L" shaped supports (two are shown 232, 234) joined by a connector base 236, a first jaw 222, a first plate 210, and a second plate 214. The first jaw 222 generally faces the moveable member 202, and the first plate 210 is generally disposed on or "under" the upside down "L" shaped supports 232, 234. The first plate 210 may be disposed substantially perpendicular to the first jaw 222. The second plate 214 may be disposed on the opposite side of the upside down "L" shaped supports 232, 234 from the first jaw 222 and may be substantially perpendicular to the connector base 236.

The moveable member 202 generally includes a second jaw or plate 220 disposed on the side of the moveable member 202 that faces or opposes the stationary member 204 and/or the first jaw 222. The second jaw 220 may be flat or textured, e.g., grooved, as desired. The moveable member 202 may also include a slider 206 that may be adapted to fit in the stationary member 204. For example, the slider 206 may slide in and out of the stationary member 204.

A void or opening (not shown) may be formed in the stationary member 204 between the supports 232, 234, the connector base 236, the first plate 210, an edge of the first jaw 222, and/or the second plate 214. The slider 206 of the moveable member 202 may have a same or similar cross-sectional shape as the void formed in the stationary member 204 and may be adapted to fit in the void between the connector base 236 and the first jaw 222. For example, the void formed in the stationary member 204 may have a square cross-section and the slider 206 may have a square or substantially square cross-section, as shown, to limit or prevent rotation of the moveable member 202. The slider 206 may be at least partially hollow and/or bored therethrough. The slider 206 may have a first end disposed on and/or secured onto the second jaw 220 and an opening in a second end adapted to receive a first or "upper" tightener 216 therethrough.

The first tightener 216 is generally disposed through the second plate 214 of the stationary member 204 and may be disposed on or otherwise connected to the moveable member 202 through the opening in the second end of the slider 206. For example, a shaft 226 of the first tightener 216 may be disposed, at least partially, through an opening defined in the second plate 214 of the stationary member 204 and threadably engaged with an opening defined in the moveable member 202. In another example, the shaft 226 may be fixed to the moveable member 202 and threadably engaged with the opening in the second plate 214 of the stationary member 204.

The tightener 216 is generally adapted to draw the jaws 220, 222 together and/or to push the jaws 220, 222 apart. For example, the tightener 216 may draw the jaws 220, 222 together when rotated in a first direction, e.g., a clockwise turn, and may push the jaws 220, 222 apart when rotated in a second direction, e.g., a counter-clockwise turn. The slider 206 of the moveable member 202 is adapted to slide back and forth in the void formed in the stationary member 204 as the jaws 220, 220 move together or apart.

A second or "lower" tightener 218 may also be disposed in the stationary member 204 through the first jaw 222. The second tightener 218 may have a shaft 228 threadably engaged with an opening 230 in the first jaw 222. The opening 230 may be threaded or have a threaded nut disposed proximate thereto. The second tightener 218 may be adapted to rotate and thereby apply pressure to the structure on which the boot 200 may be placed.

A connector 208 is generally disposed on the connector base 236 and may be adapted to receive a base leg, e.g., base legs 101, 103 in FIG. 1, of the safety rail 100. The connector 208 may be shaped to have one of the base legs 101, 103 disposed therethrough, and thereby rest on and/or be supported by the connector base 236. For example, if the base legs 101, 103 have a square cross-section, the connector 208 may be a hollowed out rectangular prism with the connector base 236 forming its base and a square cross-sectional opening opposite the connector base 236 adapted to receive one of the base legs 101, 103. It will be appreciated, however, that the connector 208 may have other cross-sectional shapes that correspond to the cross-sectional shapes of the base legs 101, 103. For example, the connector 208 may have a circular cross-section having a slightly larger circumference than the circumference of base legs 101, 103 having a circular cross-section. One or more gussets (two are shown 212, 238) may be disposed between the connector base 236 and the connector 208 for added structural support and increased weight bearing. The connector 208 may also include one or more holes (one is shown 224) therethrough that are adapted to receive a pin, e.g., pins 133, 135 in FIG. 1.

The connector 208 may be at least partially disposed over the first plate 210. For example, the connector 208 may be centered over the first plate 210 or may be offset. In another example, the connector 208 may be centered over an edge of a perpendicular wall, slat, and/or combination thereof. The connector 208 may distribute the weight of a base leg (e.g., one of the base legs 101, 103) over at least a portion of the structure to which the boot 200 is attached.

In operation, the moveable member 202 may cooperate with the stationary member 204 to fix the boot 200 onto a base structure (e.g., the wall 150 in FIG. 1) in a construction site, excavation site, work zone, or the like. The moveable member 202 may be adjusted to extend from the stationary member 204 and fit on or over the base structure. For example, the first tightener 216 may be loosened to move the second jaw 220 of the moveable member 202 away from the first jaw 222 of the stationary member 204. Once the jaws 220, 222 have been moved apart, the first plate 210 of the stationary member 204 may be placed onto the top of the base structure. By actuating the first tightener 216 (e.g., by rotating the tightener 216), the slider 206 of the moveable member 202 is generally drawn into the void formed in the stationary member 204, and the second jaw 220 of the moveable member 202 moves towards the first jaw 222 of the stationary member 204. When the slider 206 and the housing 214 are substantially square shaped, e.g., square with rounded edges, rotation of the slider 206 and the rest of the moveable member 202 may be limited as it is drawn towards the stationary member 204.

The first tightener 216 may be rotated until the second jaw 220 engages a first side of the base structure on which the boot 200 is placed and the first jaw 222 of the stationary member 204 engages a second side of the base structure. The first tightener 216 may be rotated further to clamp the boot 200 securely onto the base structure. Once the first tightener 216 has been tightened, the second tightener 218 may be rotated, e.g., by hand, to force the shaft 228 of the second tightener 218 towards the base structure to apply pressure thereon. When both the first and second tighteners 216, 218 are completely tightened, the boot 200 may fit snugly and precisely onto the base structure to provide a safe and tight fit for the boot 200 and the safety rail 100.

As discussed and described above, the boot 200 may be adapted to attach to shield and shoring equipment and/or other construction equipment or structures, including varying wall thicknesses required to meet safety standards for an excavation or construction site. The boot 200 is generally adjustable so that the same boot 200 may be used for varying wall and/or structure thicknesses. For example, the boot 200 may be adjusted to clamp onto walls and/or structures ranging from a low of about 2 cm, about 4 cm, about 6 cm, or about 8 cm to a high of about 24 cm, about 26 cm, about 28 cm, or about 30 cm.

FIG. 3 depicts a side view of a connection between two safety rails 100, 300, according to one or more embodiments. In at least one embodiment, the first sleeve connector 113 of the safety rail 100 is generally aligned with a second sleeve connector 315 and a third sleeve connector 317 of the second safety rail 300, and a pin, fastener, or dowel 370 is generally disposed through the aligned sleeve connectors 113, 315, 317 to secure the first safety rail 100 to the second safety rail 300.

The dowel 370 may be solid, having one end slightly tapered and/or rounded to facilitate travel through the sleeve connectors 113, 315, 317. The dowel 370 may have a width sufficient to fit into an opening disposed through the sleeve connectors 113, 115, 117. For example, the dowel 370 may have a width of about 1.75 to about 2 cm. The tapered end of the dowel 370 may have hole 372 bored therethrough to receive a pin or tie (not shown) that may limit and/or prevent the dowel 370 from being dislodged from the sleeve connectors 113, 315, 317. Although not shown, a bolt, nail, screw, or the like, may be used instead of the dowel 370.

A cap 371 may be disposed at an end of the dowel 370 opposite the tapered end to prevent the dowel 370 from falling through the openings in the sleeve connectors 113, 315, 317. The cap 371 may have a circular or square cross-section and may have a width the same as the width of the dowel (i.e., from about 1.75 to about 2 cm) in one direction and a length of about 2 cm to about 4 cm, e.g., a length and/or width sufficient to grip by hand. Although not shown, a cord or chain may be disposed on and/or secured to the cap 371. For example, a 30 cm long chain having 0.5 cm chain lengths may be disposed on the cap 371. The cord or chain disposed on the cap 370 may aid removal of the dowel 370 from the sleeve connectors 113, 315, 317 and/or may be tightened around the posts 109, 311 as an extra safety measure.

The dowel 370 may vary in length to fit through at least one connector, e.g., connector 113, of the safety rail 100 and at least one connector, e.g., connector 315 and/or 317 of the second safety rail 300. For example, the length of the dowel 370 may range from a low of about 20 cm, about 25 cm, about 30 cm, or about 35 cm to a high of about 45 cm, about 50 cm, about 55 cm, or about 60 cm.

The dowel 370 and the opening of the sleeve connectors 113, 315, 317 may have the same or similar cross-sectional shape. For example, the sleeve connectors 113, 315, 317 may be hollowed out cylinders and the dowel 370 may be a solid cylinder, where the circumference of the dowel 370 is slightly less than that of the sleeve connectors 113, 315, 317. When the dowel 370 is cylindrical, the circumference may range, for example, from a low of about 1 cm, about 1.5 cm, or about 2 cm to a high of about 2.5 cm, about 3 cm, or about 3.5 cm. Although not shown, the sleeve connectors 113, 315, 317 and the dowel 370 may have a variety of cross-sectional shapes including, but not limited to, square, squared with rounded corners, triangular, elliptical, diamond-shaped, pentagonal, hexagonal, trapezoidal, or the like.

In operation, the two safety rails 100, 300 may be disposed on a base structure at a construction or excavation site, so that the first sleeve connector 113 on the first post 109 of the first safety rail 100 may be positioned between the second sleeve connector 315 and the third sleeve connector 317 on the post 311 of the second safety rail 300. The safety rails 100, 300 may be further adjusted so that the sleeve connectors 113, 315, 317 and the opening formed therethrough are in substantial alignment. The boots (e.g., boot 200 described in FIG. 2) of the safety rails 100, 300 may then be tightened to secure the safety rails 100, 300 to the base structure.

Either before or after the boots are tightened, the tapered end of the dowel 370 may be inserted in the second sleeve connector 315 of the second safety rail 300 and then through the first connector 113 and third sleeve connector 317, until the cap 371 rests on the second sleeve connector 315. The dowel 370 may act as a pivot point between the safety rails 100, 300 allowing the safety rails 100, 300 to be used at a plurality of directions. For example, four safety rails (not shown) may be connected in a square or rectangle to provide fall protection for square or rectangular excavations.

If a chain or chord is attached to the cap 371, it may be wrapped at least partially around the posts 109, 311 of the safety rails 100, 300 to further secure the posts 109, 311 together. To disconnect the safety rails 100, 300, the dowel 370 may be removed and the boots loosened so that the two safety rails 100, 300 may slide apart.

Although not shown, it will be appreciated that the same method of connecting and disconnecting the safety rails 100, 300 may be used for the other side of the safety rails 100, 300. In this way, a plurality of safety rails 100 or 300 may be interconnected together to provide fall protection for both uniform and non-uniform structures. This connection system allows the safety rails 100, 300 to be quickly disposed on a structure and connected together, thereby providing adaptable fall protection for both large and small construction sites, work zones, excavation sites, or the like.

Embodiments of the present disclosure further relate to any one or more of the following paragraphs:

1. A safety rail, comprising a body disposed on first and second adjustable boots adapted to secure the safety rail to an excavation support structure, the body comprising a lower rail connected to the first and second adjustable boots.
2. The safety rail of paragraph 1, further comprising: a first base leg connecting the first adjustable boot to the lower rail; and a second base leg connecting the second adjustable boot to the lower rail, wherein the first and second base legs are disposed between ends of the body.
3. The safety rail of paragraph 2, wherein the first adjustable boot and the second adjustable boot each comprise a first tightener disposed through a first member and connected to a second member, the first tightener being adapted to draw the second member toward the first member when actuated.
4. The safety rail of paragraph 3, wherein the first member comprises a connector base and a first jaw both disposed on a one or more supports; wherein the second member comprises a slider and a second jaw, the slider being adapted to fit into the first member between the connector base and the first jaw; and wherein the first tightener is adapted to draw the second jaw toward the first jaw when rotated in a first direction and to push the second jaw away from the first jaw when rotated in a second direction.
5. The safety rail of paragraph 4, wherein the first member further comprises: a connector disposed on the connector base and adapted to receive one of the first and second base legs; a first plate disposed on the one or more supports proximate the first jaw and opposing the connector base; and a second plate disposed on an opposite side of the one or more supports from the first jaw.
6. The safety rail of paragraph 5, wherein the first tightener is disposed through the second plate of the first member, and wherein the slider is adapted to move back and forth in an opening formed in the first member between the connector base, the one or more supports, and the first plate.
7. The safety rail according to any one of paragraphs 4 to 6, wherein each of the first and second adjustable boots further comprises a second tightener disposed through the first jaw.
8. The safety rail according to any one of paragraphs 1 to 7, wherein the body is capable of withstanding, without failure, a force of about 890 N or more applied to an upper rail of the body.
9. The safety rail according to any one of paragraphs 1 to 8, wherein the lower rail is capable of withstanding, without failure, a force of about 666 N or more applied in any downward or outward direction at any point thereon.
10. A safety rail for an excavated area, comprising a body having an upper rail and a lower rail, wherein the upper and lower rails are connected to a first adjustable boot via a first base leg, and wherein the first adjustable boot is adapted to secure the safety rail to an excavation support structure.
11. The safety rail of paragraph 10, wherein the first base leg is positioned between a first side and a second side of the body.
12. The safety rail of paragraph 10 or 11, further comprising a second base leg connecting a second adjustable boot to the upper and lower rails.

13. The safety rail of paragraph 12, wherein the first base leg is removably secured to the first adjustable boot and the second base leg is removably secured to the second adjustable boot.

14. The safety rail of paragraph 12 or 13, wherein the body further comprises a first post and a second post disposed between the upper and lower rails.

15. The safety rail of paragraph 14, further comprising a first sleeve connector disposed on the first post and a second sleeve connector disposed on the second post, wherein each sleeve connector is adapted to be fastened to another sleeve connector via a fastener disposed therethrough.

16. A method for protecting an excavation area, comprising: disposing a first adjustable boot and a second adjustable boot of a first safety rail onto an excavation support structure, the first safety rail comprising a body having a lower rail connected to the first and second adjustable boots; and securing the first and second adjustable boots to the excavation support structure.

17. The method of paragraph 16, wherein the first safety rail further comprises a first base leg and a second base leg, and wherein the method further comprises removably securing the first base leg to a first connector of the first adjustable boot and removably securing the second base leg to a second connector of the second adjustable boot before the first and second adjustable boots are secured to the excavation support structure.

18. The method of paragraph 16 or 17, wherein securing the first and second adjustable boots to the excavation support structure comprises: rotating a first tightener of the first adjustable boot to secure the first adjustable boot to the excavation support structure; and 19. The method of paragraph 18, wherein rotating the first tightener of each adjustable boot draws a first jaw of each adjustable boot toward a second jaw of each adjustable boot until the first and second jaws of each adjustable boot are clamped to the excavation support structure.

20. The method according to any one of paragraphs 16 to 19, further comprising: securing a second safety rail on the excavation support structure proximate the first safety rail; aligning sleeve connectors disposed on adjoining ends of the first and second safety rails; and inserting a fastener through the aligned sleeve connectors to connect the first safety rail to the second safety rail.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A safety rail for an excavation support structure, comprising:

an upper rail spaced apart from a lower rail;

a generally vertical support post positioned between the upper and lower rails; and an adjustable boot disposed on one end of the support post, wherein the adjustable boot comprises:

a stationary member connected to the support post, wherein the stationary member is L-shaped having a generally horizontal portion and a generally vertical portion, the generally vertical portion is configured to rest against a first side surface of the excavation support structure and the generally horizontal portion is configured to sit above a top surface of the excavation structure and configured to rest thereon, a moveable member configured to rest against a second side surface of the excavation support structure, wherein the moveable member moves relative to the stationary member, and wherein the first side surface and the second side surface of the excavation support structure are opposite one another, wherein the moveable member is also L-shaped having a generally horizontal portion and a generally vertical portion, the generally horizontal portion of the moveable member configured to sit above the top surface of the excavation structure, wherein the generally horizontal portion of the moveable member and the generally horizontal portion of the stationary member are configured to at least partially overlap one another to allow the moveable member to move relative to the stationary member, and wherein the generally horizontal portions of the movable member and the stationary member each comprise a plurality of apertures formed there though to allow a fastener to retain the horizontal portions in a fixed position relative one another, and wherein the boot is configured such that the apertures align over the top of the excavation structure.

2. The safety rail of claim 1, wherein the stationary member is made of one tubular portion or multiple tubular portions.

3. The safety rail of claim 1, wherein the generally horizontal portion of the moveable member is configured to move back and forth within the generally horizontal portion of the stationary member to adjust the spacing between the respective vertical portions of the moveable member and the stationary member.

4. The safety rail of claim 1, wherein the fastener is located over the top surface of the excavation structure and between the generally vertical portions of the moveable member and the stationary member.

5. The safety rail of claim 1, further comprising a receptacle disposed on the generally horizontal portion of the stationary member and extending upwardly therefrom, the receptacle being adapted to receive and hold the one end of the support post.

6. The safety rail of claim 1, further comprising a generally horizontal support plate mounted on an upper surface of the generally horizontal portion of the stationary member, wherein the receptacle is disposed on top of the generally horizontal support plate.

7. The safety rail of claim 1, further comprising a generally horizontal support plate that is mounted to an underside of the generally horizontal portion of the stationary member, and that is adapted to directly engage and rest on the top surface of the support structure.

8. A safety rail for an excavation support structure, comprising:

an upper rail;

a lower rail that is generally parallel to the upper rail;

a first generally vertical support post adjacent a first end of the upper and lower rails;

a second generally vertical support post adjacent a second end of the upper and lower rails, wherein the first and second support posts are generally parallel to one another, an adjustable boot disposed on a lower end of each support post, the adjustable boot configured to clamp onto an excavation support structure, wherein each adjustable boot comprises:

a stationary member connected to the support post, wherein the stationary member is L-shaped having a generally horizontal portion and a generally vertical portion, the generally vertical portion is configured to rest against a first side surface of the excavation support structure and the generally horizontal portion is configured to sit above a top surface of the excavation structure and rest thereon;

a moveable member that moves relative to the stationary member, and configured to rest against a second side surface of the excavation support structure, wherein the first side surface and the second side surface of the excavation support structure are opposite one another, wherein the moveable member is also L-shaped having a generally horizontal portion and a generally vertical portion, the generally horizontal portion of the moveable member configured to sit above the top surface of the excavation structure, and wherein the generally horizontal portion of the moveable member and the generally horizontal portion of the stationary member are configured to at least partially overlap one another to allow the moveable member to move relative to the stationary member; and a tightener configured to engage the excavation support structure, wherein the tightener is disposed through the generally vertical portion of the stationary member, and wherein the generally horizontal portion of the moveable member is configured to extend over the top surface of the excavation support structure.

9. The safety rail of claim 8, wherein the stationary member is made of one tubular portion or multiple tubular portions.

10. The safety rail of claim 8, wherein the moveable member is configured to move back and forth in relation to the stationary member to adjust the spacing between the moveable member and the stationary member.

11. The safety rail of claim 8, wherein the generally horizontal portions of the moveable member and the stationary member each comprise a plurality of apertures formed therethrough that when aligned over the top of the excavation structure allow a fastener to retain the generally horizontal portions in a fixed position relative to one another.

12. The safety rail of claim 8, further comprising a receptacle disposed on the generally horizontal portion of the stationary member and extending upwardly therefrom, the receptacle being adapted to receive and hold the one end of the support post.

13. The safety rail of claim 8, further comprising a generally horizontal support plate mounted on an upper surface of the generally horizontal portion of the stationary member, wherein the receptacle is disposed on top of the generally horizontal support plate.

14. The safety rail of claim 8, further comprising a generally horizontal support plate that is mounted to an underside of the generally horizontal portion of the stationary member, and that is adapted to directly engage and rest on the top surface of the support structure.

15. A safety rail for an excavation support structure, comprising:

an upper rail spaced apart from a lower rail;

a generally vertical support post connect to the upper and lower rails; and an adjustable boot disposed on one end of the support post, wherein the adjustable boot comprises:

a stationary member configured to rest against a first side surface of the excavation support structure, wherein the stationary member comprises a generally horizontal portion and a generally vertical portion, the generally horizontal portion connected to the support post;

a moveable member configured to rest against a second side surface of the excavation support structure, wherein the moveable member moves relative to the stationary member, and wherein the first side surface and the second side surface of the excavation support structure are opposite one another;

wherein the moveable member comprises a generally horizontal portion extending from a generally vertical portion, wherein the generally horizontal portion of the moveable member and the generally horizontal portion of the stationary member are configured to at least partially overlap one another; and a tightener configured to engage the excavation support structure and more securely hold the adjustable boot on the excavation support structure, wherein the generally horizontal portion of the moveable member is disposed above the excavation support structure and rests thereon;

wherein the moveable member and the stationary member each comprise a generally vertical plate disposed on their respective generally vertical portions that engages the opposing side surfaces of the excavation support structure; and wherein the tightener is disposed through the plate on the stationary member to engage the first side surface of the excavation support structure.

16. The safety rail of claim 15, wherein the adjustable boot further comprises a second tightener disposed through the stationary member, and configured to move the moveable member toward the stationary member when actuated in a first direction and away from the stationary member when actuated in a second direction.

17. The safety rail of claim 15, wherein the generally horizontal portion of the moveable member is configured to move back and forth within the generally horizontal portion of the stationary member to adjust the spacing between the moveable member and the stationary member.

18. The safety rail of claim 17, wherein the generally horizontal portion of the moveable member and the horizontal portion of the stationary member comprise a plurality of apertures formed therethrough to allow a fastener to retain the generally horizontal portions in a fixed position relative to one another.

19. The safety rail of claim 15, further comprising:

a receptacle disposed on the generally horizontal portion of the stationary member and extending upwardly therefrom, the receptacle being adapted to receive and hold the one end of the support post; and a generally horizontal support plate mounted on an upper surface of the generally horizontal portion of the stationary member, wherein the receptacle is disposed on top of the generally horizontal support plate.

20. The safety rail of claim 15, further comprising a generally horizontal support plate that is mounted to an underside of the generally horizontal portion of the stationary member, and that is adapted to directly engage and rest on the top surface of the support structure.

* * * * *